US005224238A

United States Patent [19]

Bartlett

[11] Patent Number: 5,224,238

[45] Date of Patent: Jul. 6, 1993

[54] HORIZONTAL CANISTER VACUUM

[75] Inventor: Michael D. Bartlett, Pickens, S.C.

[73] Assignee: Ryobi Motor Products Corp., Easley, S.C.

[21] Appl. No.: 687,122

[22] Filed: Apr. 18, 1991

[51] Int. Cl.[5] ..... A47L 9/22

[52] U.S. Cl. ..... 15/327.2; 15/327.6; 15/327.7; 15/352; 15/412

[58] Field of Search ..... 15/347, 352, 412, 327.6, 15/344, 327.2

[56] References Cited

U.S. PATENT DOCUMENTS

| | | | |
|---|---|---|---|
| 2,219,567 | 10/1940 | Spielman | 15/327.6 X |
| 2,277,069 | 3/1942 | Burwell | 15/327.6 X |
| 3,334,370 | 8/1967 | Boyd | 15/327.2 |
| 3,513,500 | 5/1970 | Hori | 15/344 |
| 3,775,951 | 12/1973 | Eicholz et al. | 15/327.6 X |
| 4,783,878 | 11/1988 | McCambridge | 15/327.6 |

FOREIGN PATENT DOCUMENTS

| | | | |
|---|---|---|---|
| 1064700 | 9/1959 | Fed. Rep. of Germany | 15/413 |

*Primary Examiner*—Chris K. Moore
*Attorney, Agent, or Firm*—Brooks & Kushman

[57] ABSTRACT

A horizontal canister vacuum having a cover removably attached to the open end of a canister having a motor/fan assembly affixed thereto and cooperating with an air outlet to evacuate air from the interior cavity. A plurality of wheels provided for solidly supporting the canister and attached cover in a horizontal orientation when placed upon a flat surface and wherein accumulated dust particles may be emptied from the vacuum cleaner by removing the cover from the canister when the vacuum cleaner is positioned in a vertical orientation. A clam-shell configuration is provided for packaging the motor/fan assembly to direct air flow through the assembly for cooling thereof.

8 Claims, 5 Drawing Sheets

HORIZONTAL CANISTER VACUUM

TECHNICAL FIELD

This invention relates to canister-type dry vacuum cleaners and more particularly to mechanisms enabling operation in both the horizontal and vertical orientations.

BACKGROUND ART

Many canister-type vacuum cleaners have traditionally been operable in either the horizontal orientation or the vertical orientation.

For instance, U.S. Pat. No. 3,755,992 to Ylien discloses a vacuum design for collecting lawn-related debris which does not use a filter element. Instead, a screen is placed across the opening between the fan and the canister to prevent large particles from entering the canister. In this construction, the device can only be utilized in the horizontal position.

U.S. Pat. No. 4,193,161 to Scott discloses a vacuum apparatus which may be moved between a use position and a dumping position. In this construction, it is only possible to utilize the apparatus with an upright canister vacuum.

U.S. Pat. No. 2,018,207 to Giambertoni discloses a vacuum cleaner designed to reduce noise of the motor during operation. The device includes a filter cowl within the casing defining a return flow passage for air flow from the suction pump, thereby deadening the sound of a motor. In this configuration, the device is incapable of being used in both the vertical and horizontal orientation.

U.S. Pat. No. 3,279,157 to Andersson-Sason et al discloses a suction cleaner having a removable dust bag including a second fine filter adjacent the outlet to remove fine dust particles which manage to get through the dust bag before the air is discharged into the room. The disclosed device in only operable in the horizontal position.

Traditionally, vacuum cleaners have positioned the motor in such a location as to prohibit the removal of the motor and filter in conjunction with the cover of the canister enabling the entire canister to function as a storage location for debris.

For example, U.S. Pat. No. 3,653,189 to Miyake et al discloses a horizontal canister vacuum wherein the filter element remains with the canister portion when the motor/fan assembly and cover are removed. In this construction, it is necessary to first remove the motor/-fan assembly and the cover as well as the filter assembly prior to emptying the canister.

U.S. Pat. No. 2,962,118 to Lee et al discloses an electric vacuum cleaner having an entire motor/fan assembly within the canister in combination with a pair of air plenum chambers to achieve a quiet motor which is vibration-free during operation. The device relies upon a radial diffusion of discharged air in cooperation with a baffle to decrease the noise of the motor during operation. In this construction, because of the location of the inlet along the side wall of the canister, the entire space of the canister may not be used for collection of dust and debris.

Conventional vacuum cleaners have not packaged the motor/fan assembly in a clam-shell configuration to direct air flow to cool the assembly. For instance, U.S. Pat. No. 3,458,891 to Grellsson discloses a suction cleaner having an inlet at one end and a first outlet located in the middle of the canister at the bottom thereof. Air then flows through an air duct to a fine filter at the opposite end of the canister from the inlet improving the quality of air which is released at the second outlet from the canister. This device does not direct air flow through the motor to improve cooling.

U.S. Pat. No. 3,524,211 to Wolf discloses a vacuum cleaner with an air direction for directing an air stream against the interior wall of a dust bag to clear it from debris and dust, thereby maintaining sufficient suction. The device is not capable of operation in both the horizontal and vertical orientation. Nor is the direction means for directing the air stream used to improve cooling of the motor.

U.S. Pat. No. 4,797,072 to Berfield et al and related U.S. Patent No. 4,836,753 discloses a portable electric blower having a separate main air flow through the blower from another air flow past the motor which operates the blower. The device has an upper and lower housing and a motor cap such that there is a space therebetween defining a cool air pathway for cooling the motor. In this configuration, the motor is not cooled by the vacuuming air but clean air drawn in through the motor cap by a second fan.

The present invention incorporates many of the known benefits of canister vacuum cleaners while improving the ease of use, debris storage and removal and the method of cooling the motor/fan assembly.

SUMMARY OF THE INVENTION

An object of the present invention is to provide an improved canister vacuum cleaner capable of operation in a horizontal and vertical or upright position.

To obtain the above object and other objects of the present invention, a horizontal canister vacuum is provided having a cover removably attachable to the open end of a canister having a motor/fan assembly affixed thereto and cooperating with an air outlet to evacuate air from the interior cavity. A plurality of wheels are provided for solidly supporting the canister and attached cover in a horizontal orientation when placed upon a flat surface and wherein accumulated dust particles may be emptied from the vacuum cleaner by removing the cover from the canister when the vacuum cleaner is positioned in a vertical orientation.

Accordingly, an object of the present invention is to provide a relatively inexpensive canister vacuum cleaner capable of operation in both the horizontal and vertical positions.

Another object of the present invention is to provide a clam-shell configuration for packaging the motor/fan assembly thereby decreasing production costs, improving maintenance and directing air flow through the assembly for improved cooling thereof.

A specific object of the present invention is to provide a horizontal vacuum cleaner comprising an elongated canister including an open end and a closed end adapted to rest upon a generally flat surface to support the canister in a generally vertical orientation. A tubular wall portion sealingly cooperating with the closed end defines an interior cavity. A cover removably attachable to the open end of the canister, the cover having an air inlet and an air outlet. A motor/fan assembly is affixed to the cover and cooperates with the air outlet to a evacuate air from the interior cavity. A filter means is affixed to the cover and oriented within the interior cavity cooperating with the motor/fan assembly for filtering the evacuated air and for separating and retaining dust particles within the portion of the interior cavity defined by the canister walls in the filter element. A plurality of wheels are spaced apart for solidly supporting the canister and the attached cover in a horizontal orientation when placed upon a flat surface. The vacuum is operable in either the horizontal or vertical orientation and the accumulated dust particles may be emptied from the canister by removing the cover from the canister when the vacuum cleaner is positioned in the vertical orientation.

Another specific object of the present invention is to provide a vacuum cleaner having a container with an open end and a closed end and a removable cover for closing the open end. The cover having an air filtration system affixed thereto and removable therewith. The air filtration system including an air inlet and air flow communication with the container for receiving debris-ladened outside air. An air outlet is provided in air flow communication with the air inlet for exhausting air from the container to the outside. A filter is provided between the air inlet and the air outlet and in gravity drop relation with the container for separating debris from the debris-ladened air. A motor fan is provided for establishing a vacuuming air flow from the air inlet to the air outlet through the filter and for depositing the debris at least partially in gravity drop relation with the container. Wheels are provided on the container and the cover to facilitate moving the container in a horizontal orientation when the vacuuming air flow is established. The closed end is configured to solidly support the container in a vertical orientation when the cover is removed whereby to facilitate dumping of debris deposited therein by gravity drop from the filter.

A further specific object of the present invention is to provide a vacuum cleaner having an elongated canister with a wall defining an interior cavity having an open top. A cover removably attachable to the canister open top and an air inlet in fluid communication with the canister interior cavity including means for removably attaching a conduit thereto. A motor/fan assembly is affixed to the cover and including a fan intake and an air outlet for evacuating air from the interior cavity. A filter element is oriented within the canister bisecting the internal cavity into a first region bounded by the cavity walls, the filter element and the cover, with the first region in direct communication with the air inlet and a second region in fluid communication with the fan intake. The second region is separated from the first region by the filter element. The motor/fan assembly includes a coaxially affixed armature and fan into substantially complementary housing members which cooperate with on another along a common plane extending through the axis of the armature and fan. The housing members define therebetween an armature cavity and a longitudinally spaced air outlet in fluid communication with the armature cavity. The fan intake is situated outside of the two housing members along the same axis and in fluid communication with the armature cavity so that the air evacuated from the canister's second region is pumped by the fan into the armature cavity and out through the air outlet.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
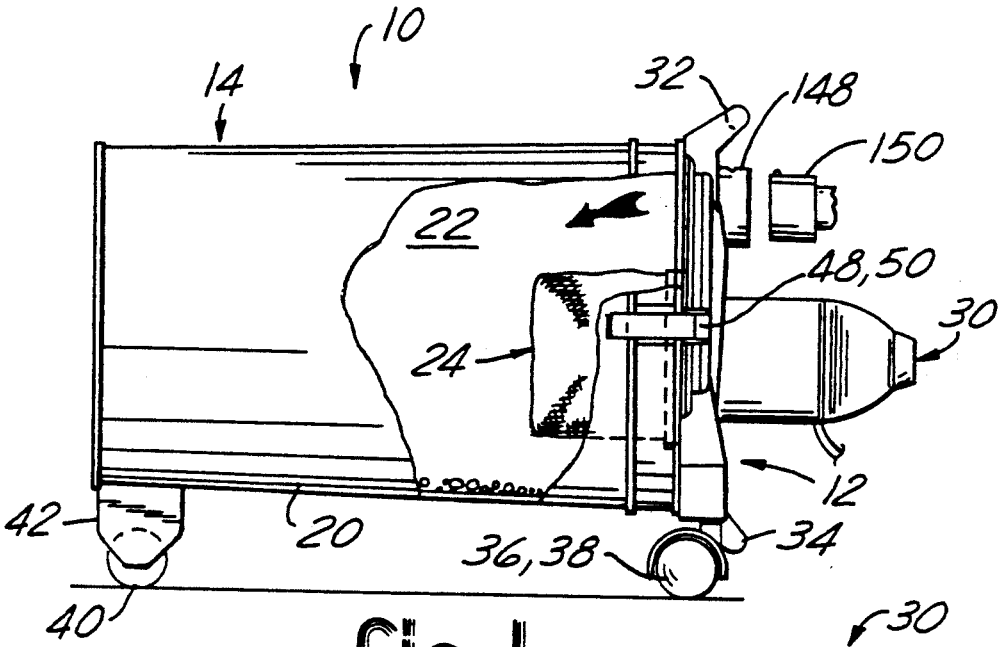
FIG. 1 is a perspective view of a horizontal canister vacuum partially broken away showing a portion of the internal elements of the present invention.

The preferred embodiment as shown in FIGS. 1 through 5, illustrates a vacuum cleaner 10, having a cover 12 and a canister 14 which is operable in both the upright and horizontal positions.

The canister 14 has an open end, generally indicated at 16 and an closed end, generally indicated at 18. The canister 14 has a canister wall 20, generally tubular in shape cooperating with the cover 12 and the closed end 18 to define an internal cavity, generally indicated at 22. A filter element 24 is within the canister 14. An air outlet 30 is affixed to the cover 12 for evacuating filtered air.

Figure 2:
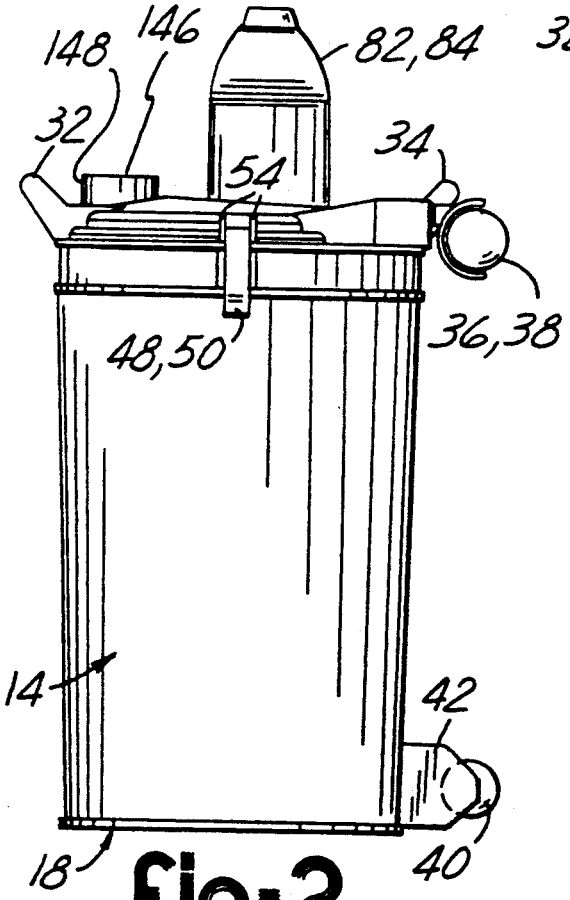
FIG. 2 is a perspective view of the horizontal canister vacuum in the vertical or upright position.
Figure 4:
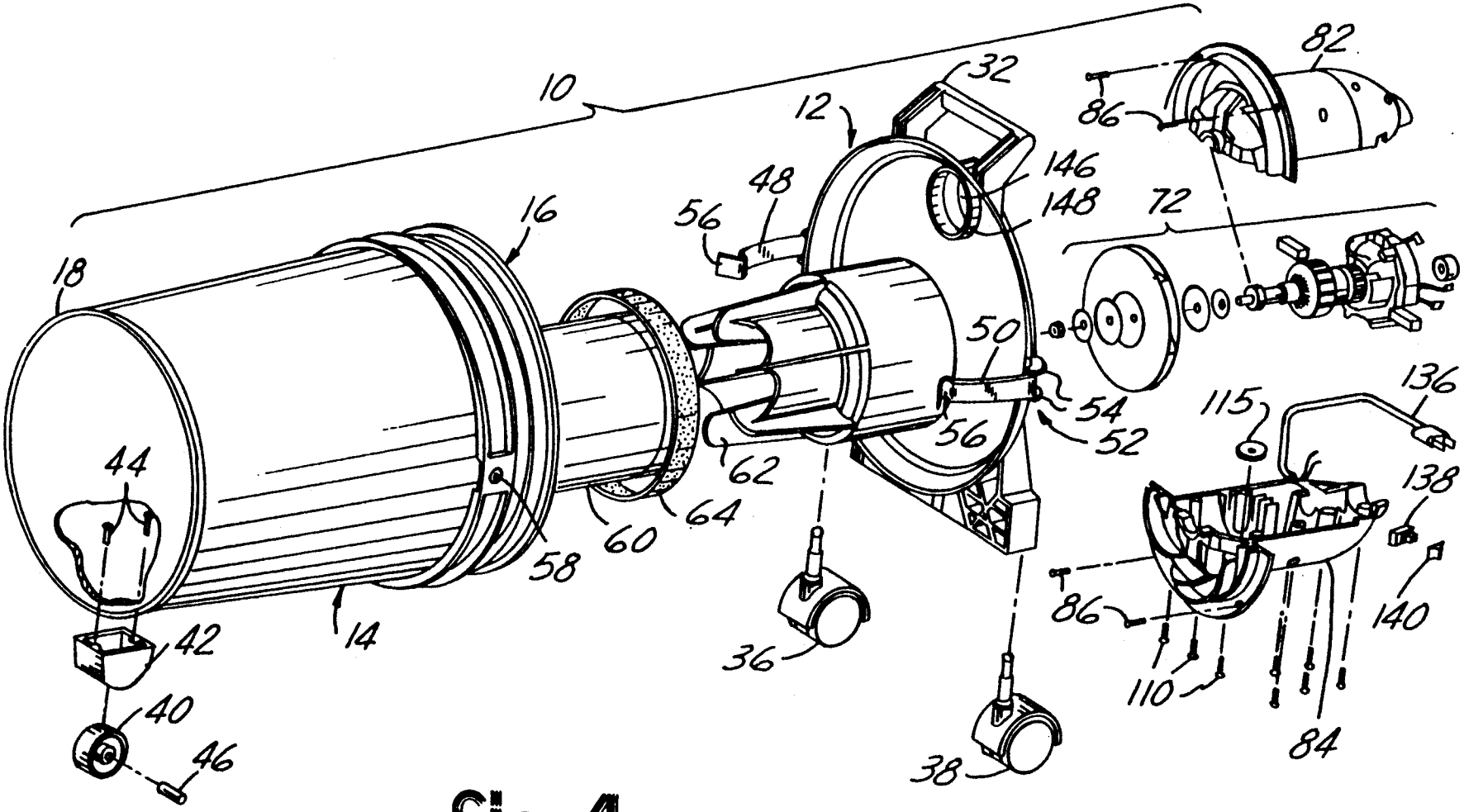
FIG. 4 is an exploded view similar to that shown in FIG. 1, illustrating the internal elements of the present invention.
Figure 4A:
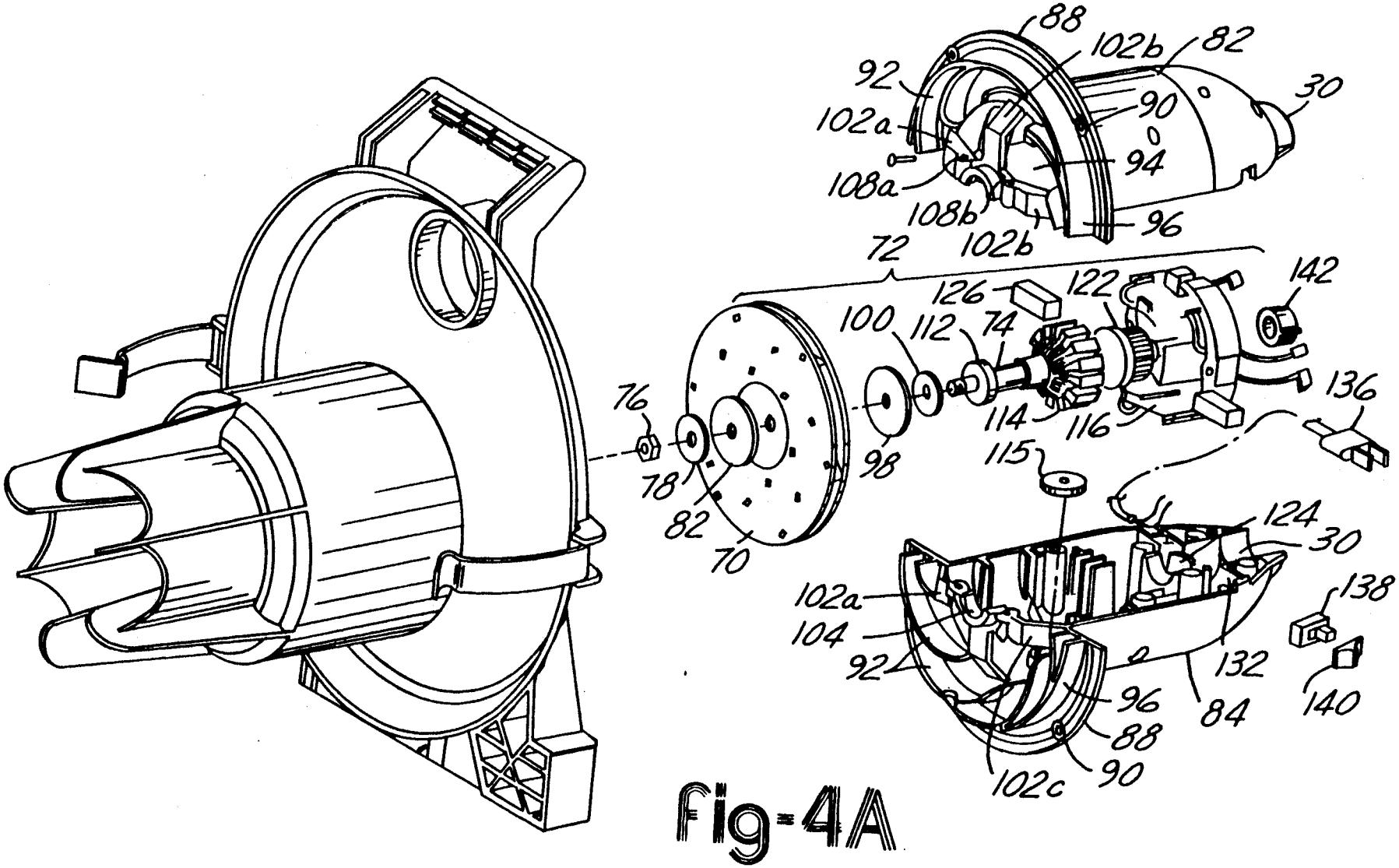
FIG. 4A is an exploded view similar to that shown in FIG. 4, illustrating elements of the fan/motor assembly in greater detail.

Two handles 32 and 34 are located at opposite ends of the outermost edge of the generally circular cover 12 to provide easy steering of the vacuum cleaner 10 during operation in either the horizontal or upright position (as shown in FIGS. 1 and 2 respectively). A pair of casters 36 and 38 are affixed to the cover 12, laterally spaced apart on opposite sides of the lowest handle 34 when in the horizontal position as shown in FIGS. 1 and 4, cooperating with a tail wheel 40 centrally located along the midline of the canister wall 20 at the closed end 18 of the canister 14 to ensure stability of the vacuum cleaner 10 during operation in the horizontal position and to provide improved leverage in the upright position when removing the cover 12. The tail wheel 40 is connected to the canister 14 by a spacer 42 fastened by conventional means such as screws or rivets 44. The tail wheel 40 is rotatably attached to the spacer 42 by means of an axle pin 46 which is press-fit into the spacer 42.

A pair of clamps 48 and 50 are centrally located on opposite sides of the cover 12 between the handles 32 and 34 to enable the attachment and removal of the cover 12 from the canister 14. Each clamp 48 and 50 is identical such that the description of one clamp 48 is also a description of clamp 50. As best shown in FIG. 4, clamp 48 is connected to the cover 12 by a pin 52 having two retainer pieces 54 which are molded to the cover 12 to affix the clamp 48 to the outer edge of the cover 12 while allowing the clamp 48 to pivot about the pin 54. The clamp, generally rectangular in shape has a downward bend along its longitudinal axis and having a outwardly curving hook 56 at its free end thereby biasing or pre-stressing the clamp 48 against the canister 14 in the closed or locked position. The hook 56 of the clamp 48 cooperates with a shoulder piece 58 to securely fasten the cover 12 to the canister 14.

Figure 3:
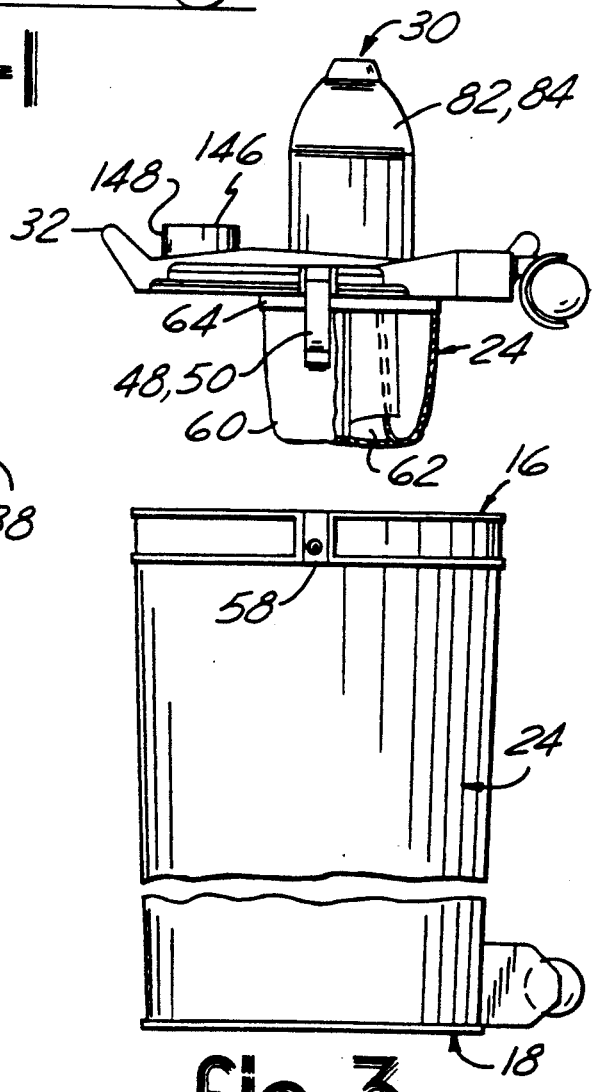
FIG. 3 is a perspective view similar to that shown in FIG. 2 showing the removal of the cover and affixed elements.

With the cover 12 removed from the canister 14 (as shown in FIGS. 3 and 4), it can be seen that the filter element 24 is a paper or cloth bag filter 60 which covers a molded bag support 62 which is integrally connected to the cover 12 and ensures that the filter 60 is maintained in the open position during operation. The filter is attached to the bag support 62 by means of a rubber band 64.

At the point where the bag support 62 and the cover 12 meet, a pocket region 67 is formed. Within the pocket region 67, a pocket 68 is formed which houses an impeller 70 (see FIG. 5). The impeller is spaced above a first shoulder 69 within the pocket region 67. The impeller 70 forms the first stage in a fan/motor assembly 72 which provides the power for the vacuum cleaner 10. The entire fan/motor assembly 72 is connected by a shaft 74 extending through the longitudinal axis of each of its elements.

The impeller 70 is secured to the bottom of shaft 74 by means of a nut 76 and a series of washers 78 and 80, such that washer 80 is larger relative to washer 78. The impeller 70 is an enclosed unit, generally circular in shape, housing a series of vanes or blades which drive air along its peripheral edge in a cyclonic fashion.

The remaining elements of the fan/motor assembly 72 are enclosed within two substantially complimentary clam-shell housing members 82 and 84 respectively. Once joined by conventional fastening means such as screws or rivets, the two housing members 82 and 84 form a generally bell-shaped profile, having a circular extension defining the air outlet 30 at its free end and having a flange 88 at its attachment end. The two housing members 82 and 84 are affixed to the cover 12 by means of screws or rivets 86 which cooperate with holes 90 in the flange 88, such that the housing members 82 and 84 are inserted into and cooperable with the cover 12 to define the cup-shaped pocket 68 within the pocket region 67, which integrally houses the impeller 70 within the cover 12 directly opposite the molded bag support 62.

Figure 5:
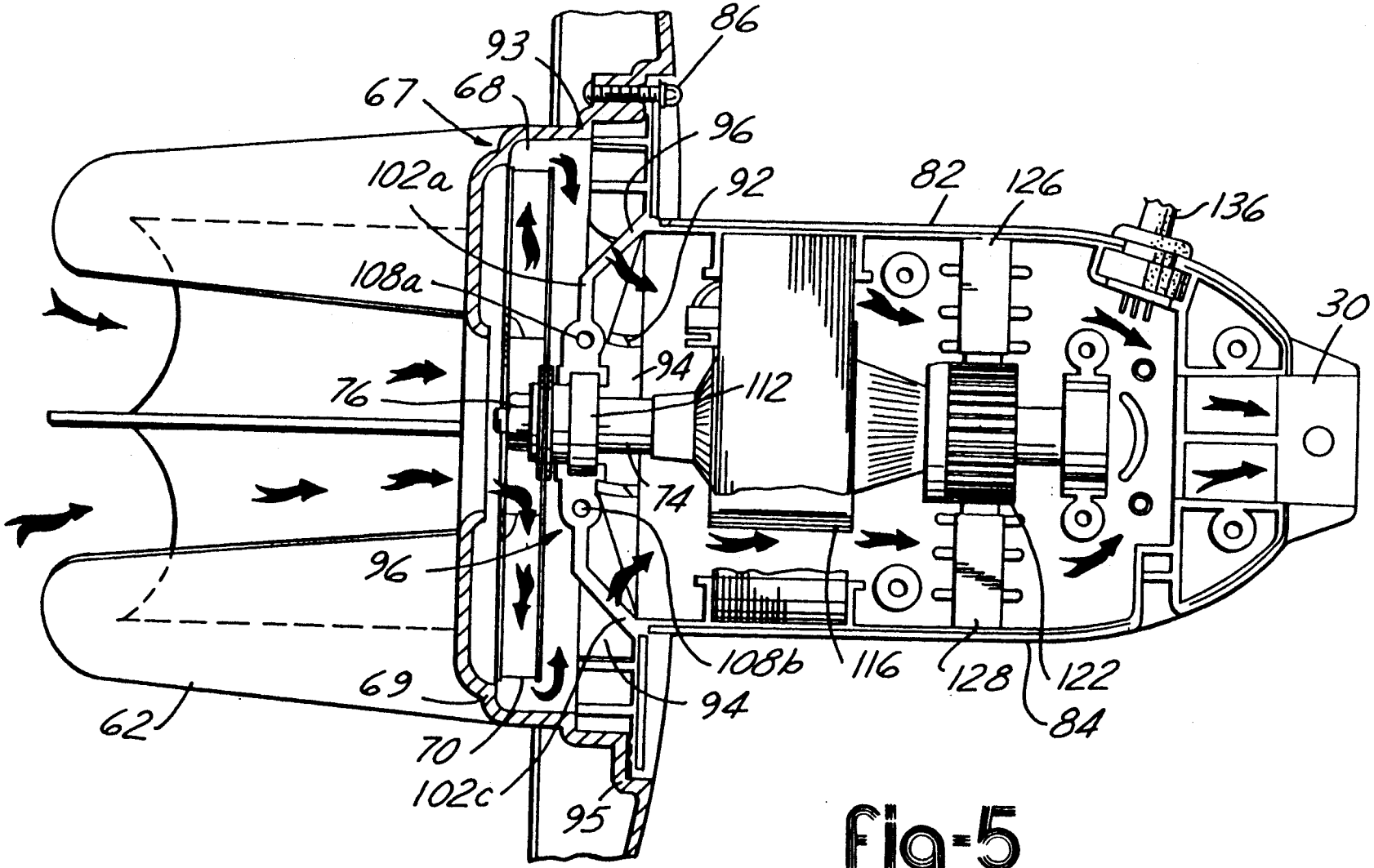
FIG. 5 is cross-sectional view similar to a that shown in FIG. 3, illustrating the internal elements of the fan/-motor assembly.

For purposes of improved description, all elements contained within the housing members 82 and 84 will be described as though the housing members 82 and 84 are joined, unless otherwise noted. Once joined, the housing members 82 and 84 are seated within the pocket region 67 and secured to the cover 12 by conventional fastening means such as screws 86. The screws 86 are located along the peripheral edge of the pocket region 67 at the second shoulder 93. As shown in FIG. 5, the second stage of the fan/motor assembly 72 is a series of vanes 92 enclosed in a cavity 94 defined by a lip 96 extending perpendicular to the flange 88 and the upper surface of the impeller 70, when the housing members 82 and 84 are affixed to the top of the cover 12. The vanes 92 are integrally formed to the lip 96 of the housing members 82 and 84. The vanes 92 begin at the peripheral edge of the cavity 94 and bend toward the middle of the cavity 94 such that their entire upper edge is affixed to the upper surface of the cavity 94. The vanes 92 extend only the width of the flange 88. The flange 88 is seated on a third shoulder 95 formed within the pocket region 67 while the vanes 92 are seated on a second shoulder 93 of the pocket region 67. The purpose of the vanes 92 is to direct the airflow back toward the center of the cavity 94 such that air flows along the interior portion of the housing members 82 and 84 to cool the fan/motor assembly 72 during operation.

A collar 96 is situated in the interior portion of the cavity 94. The collar 96 is separated from the impeller 70 by means of a washer 98 and spacer 100. The collar 96 is formed by a series of arms **102*a*, 102*b* and 102*c* which are molded to the undersurface of flange 88. The arms 102*a–c* angle downward away from the undersurface of the flange 88 toward the center of the cavity 94, and at a midpoint in the length of the arms 102*a–c* the arms bend perpendicular to the longitudinal axis of the housing members 82 and 84 toward the middle of the cavity 94. At the end of the arms 102*a–c*, opposite the affixed ends, the arms 102*a–c* form a seat 104 generally circular in shape having two flange pieces 106*a* and 106*b* respectively. The flange pieces 106*a* and 106*b* are located on either side of the seat 104. The flange pieces 106*a* and 106*b* each have a centrally located hole 108*a* and 108*b* respectively which cooperates with a screw or rivet 110 to assist in joining housing members 82 and 84**.

The third stage of the fan/motor assembly 72 is a bearing 112 situated within the seat 104 of collar 96. Also contained within the third stage of the fan/motor assembly 72 is an armature 114 located above the bearing 112 on the shaft 74. The armature 114 is situated within a coil 116 which surrounds the armature 114. A rubber bumper 115 is interposed between the coil 116 and the housing 84 to hold the coil 116 tight preventing any rattling. In this configuration of the housing 84, a rubber bumper 115 is not required, but is available if desired. The coil 116 and the armature 114 cooperate in conventional fashion with a commutator 122 positioned above the armature 114 on the shaft 74.

Extending laterally above the armature 114 and laterally against the commutator 122 are two brushes 126 and 128 respectively, seated in two cavities 130 and 132 respectively formed within the housing members 82 and 84. Adjacent cavity 130 and in contact with the brush 126, are electrical contacts 134 for an electrical plug 136. A power switch 138 is connected and cooperates with brushes 126 and 128 which are also connected to the power supply, to turn the vacuum cleaner 10 on and off. A glamour cap 140 covers the power switch 138 in press-fit relation, to highlight the power switch 138.

A bushing 142 is located in a seat 124 integrally formed within the housing members 82 and 84 to secure the upper end of the motor/fan assembly 72 to the shaft 74. The area above the commutator 122 to the bushing 142 forms the fourth stage of the motor/fan assembly 72. The bushing 142 secures the upper portion of the shaft 74 and cooperates with the bearing 112 which secures the lower portion of the shaft 74.

In operation, air is drawn into the first region 26 of the canister 14 through an air inlet 146 located adjacent the handle 32 on the cover 12. The air inlet 146 has a coupling ring 148 which cooperates in button-lock relation with a telescopic hose 150. Air is then drawn through the cloth/paper filter 60, which is shaped by the molded bag support 62, separating and retaining dust particles within the first region 26 of the canister 14. Once through the filter 60, the air is directed along the peripheral edges of the impeller 70, then to the middle of the cavity 92 by the vanes 94 which direct the air along the shaft 74 and in air cooling relation through the remaining stages of the fan/motor assembly 72 toward the air outlet 30 formed by the free ends of housing members 82 and 84 as the air is evacuated from the vacuum cleaner 10.

Figure 6:
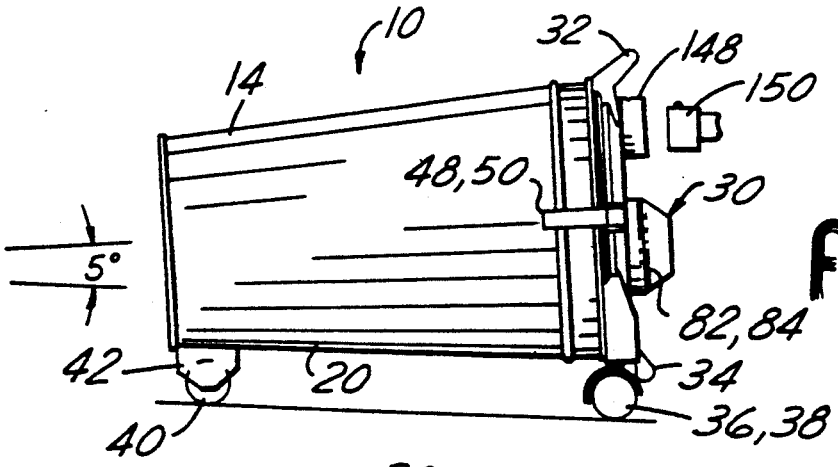
FIG. 6 is a perspective view of the horizontal canister vacuum as shown in FIG. 1, illustrating an alternative embodiment.
Figure 7:
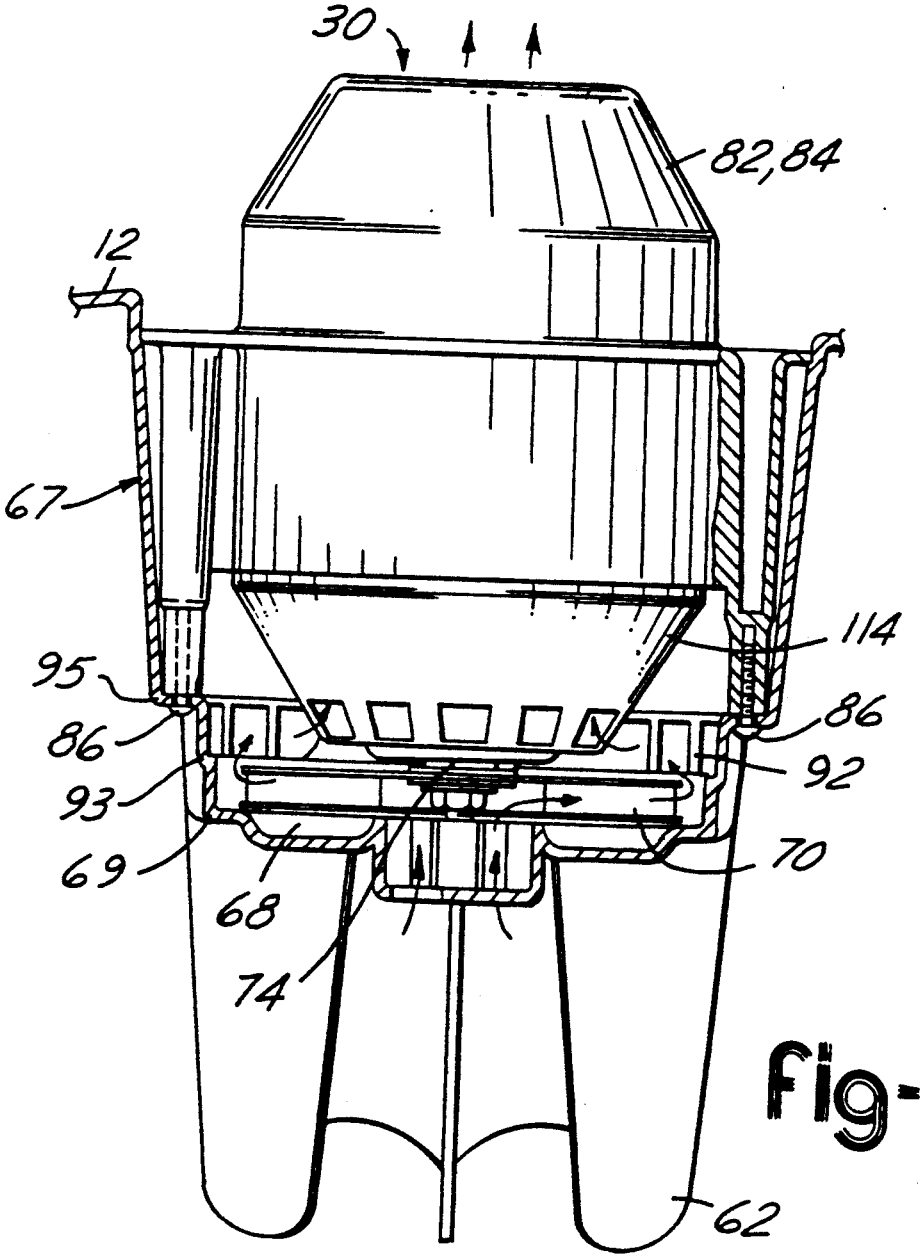
FIG. 7 is a cross-sectional view similar to FIG. 5, illustrating an alternative embodiment.

FIGS. 6 and 7 illustrate an alternative embodiment to the present invention. FIG. 6 shows the vacuum cleaner 10 having a slightly inclined open end 16 of approximately 5° from horizontal. FIG. 1 also shows the profile of the housing members 82 and 84 such that they protrude much less from the cover 12 than in the original design of the vacuum cleaner 10 as shown in FIG. 1. In this embodiment, the center of gravity of the motor/fan assembly 72 is within the canister 14, thereby improving the stability of the vacuum cleaner 10. The purpose of the inclination of the open end 16 and the lower profile of the housing members 82 and 84 is to improve the ease of movement of the vacuum cleaner 10 by use of the handle 32 or the hose 150.

FIG. 7 illustrates the alternative embodiment of the housing members 82 and 84 and the cover 12. In this embodiment, the pocket region 67 is much larger to house more of the motor/fan assembly 72 such that the first three stages of the motor/fan assembly 72 are contained therein. By so doing, the center of gravity of the motor/fan assembly 72 is contained within the canister 14 improving the ease of movement of the vacuum cleaner 10.

While the best mode for carrying out the invention has been described in detail, those familiar with the art to which this invention relates will recognize various alternative designs and embodiments for practicing the invention as defined by the following claims.

What is claimed is:

1. A vacuum cleaner comprising:

an elongated canister having a wall defining an interior cavity with an open top;

a cover removably attachable to the canister open top;

an air inlet in fluid communication with the canister interior cavity including means for removably attaching a conduit thereto;

a motor/fan assembly affixed to the cover in cooperation with the open top and including a fan intake in communication with the interior cavity and an air outlet for evacuating air from the interior cavity;

a filter element oriented within the canister dividing the internal cavity into a first region bounded by the cavity walls, the filter element and the cover, with the first region in direct communication with the air inlet, and a second region in fluid communication with the fan intake, wherein the second region is separated from the first region by the filter element;

wherein the motor/fan assembly includes an armature and fan affixed to one another along a common axis, and two substantially complementary housing members which cooperate with one another along a common plane extending through the axis of the armature and fan, the housing members defining therebetween an armature cavity and an air outlet which is longitudinally spaced from the armature cavity; and the fan intake is situated outside of the two housing members along the axis and in fluid communication which the armature cavity so that air evacuated from the canister second region is pumped by the fan into the armature cavity and out through the air outlet.

2. The vacuum cleaner of claim 1 wherein the air outlet is aligned along the motor armature and fan axis.

3. The vacuum cleaner of claim 1 further comprising a plurality of wheels affixed to the canister and the cover for stablilizers supporting the vacuum cleaner in a substantially horizintal orientation and wherein the air inlet is located in the uppermost portion of the cover when the vacuum cleaner is positioned in said horizintal orientation.

4. The vacuum cleaner of claim 3 further comprising a pair of handles affixed to the cover, one being located along the outermost portion of the cover when the vacuum is in the horizontal orientation and the other handle positioned below and opposite thereto.

5. The vacuum cleaner of claim 1 wherein the fan/-motor assembly further comprising a plurality of vanes for directing airflow from the fan through the motor assembly toward the air outlet.

6. The vacuum cleaner of claim 1 wherein the cover further comprising a molded bag support integrally formed in the cover, surrounding the fan inlet.

7. The vacuum cleaner of claim 6 wherein the filter element further comprising a paper bag attached to the molded bag support by means of a rubber band.

8. The vacuum cleaner of claim 1 wherein the air intake and the air outlet are coaxially aligned.

* * * * *